US006187733B1

(12) United States Patent
Fabry et al.

(10) Patent No.: US 6,187,733 B1
(45) Date of Patent: Feb. 13, 2001

(54) AQUEOUS MANUAL DISHWASHING COMPOSITION CONTAINING A MONOGLYCERIDE SULFATE AND AT LEAST TWO OTHER SURFACTANTS

(75) Inventors: Bernd Fabry, Korschenbroich; Manfred Weuthen, Solingen, both of (DE)

(73) Assignee: Henkel Kommanditgesellschaft auf Aktien, Duesseldorf (DE)

( * ) Notice: Under 35 U.S.C. 154(b), the term of this patent shall be extended for 0 days.

(21) Appl. No.: 09/254,246

(22) PCT Filed: Aug. 25, 1997

(86) PCT No.: PCT/EP97/04619

§ 371 Date: Mar. 2, 1999

§ 102(e) Date: Mar. 2, 1999

(87) PCT Pub. No.: WO98/10047

PCT Pub. Date: Mar. 12, 1998

(30) Foreign Application Priority Data

Sep. 2, 1996 (DE) ..... 196 35 555

(51) Int. Cl.[7] ..... C11D 17/00

(52) U.S. Cl. ..... 510/235; 510/425; 510/501; 510/502

(58) Field of Search ..... 510/235, 425, 510/426, 501, 502

(56) References Cited

U.S. PATENT DOCUMENTS

| | | | |
|---|---|---|---|
| 4,024,078 | 5/1977 | Gilbert et al. | 252/551 |
| 5,304,669 | 4/1994 | Wangemann et al. | 558/41 |
| 5,312,932 | 5/1994 | Behler et al. | 554/90 |
| 5,322,957 | 6/1994 | Fabry et al. | 558/23 |
| 5,484,531 | 1/1996 | Kuehne et al. | 210/653 |
| 5,489,395 | 2/1996 | Behler et al. | 252/174.17 |
| 5,599,476 | 2/1997 | Behler et al. | 510/135 |

FOREIGN PATENT DOCUMENTS

| | | |
|---|---|---|
| 26 13 283 | 10/1976 | (DE) . |
| 42 04 700 | 8/1993 | (DE) . |
| 43 03 176 | 8/1994 | (DE) . |
| 44 38 221 | 5/1996 | (DE) . |
| 0 561 825 | 9/1993 | (EP) . |
| 0 561 999 | 9/1993 | (EP) . |
| 50-070322 | 6/1975 | (JP) . |
| WO92/06952 | 4/1992 | (WO) . |
| WO94/00543 | 1/1994 | (WO) . |
| WO95/06702 | 3/1995 | (WO) . |

OTHER PUBLICATIONS

J. Am. Oil Chem. Soc. vol. 37 (1960) Biswas & Mukherji:"Surface Active Properties" pp. 171–175.

J. Am. Oil Chem. Soc. vol. 67 (1990) F.U. Ahmed:"Efficient Synthesis of Fatty Monoglyceride Sulfates from Fatty Acids and Fatty Acid Methyl Esters" pp. 8–14.

Fette, Seinfen, & Anstrichmittel vol. 74 (1972) pp. 163–165.

*Primary Examiner*—Necholus Ogden
(74) *Attorney, Agent, or Firm*—John E. Drach; Steven J. Trzaska

(57) ABSTRACT

A water-based manual dishwashing detergent composition containing (a) monoglyceride sulfates or monoglyceride ether sulfates corresponding to formula (I):

(I)

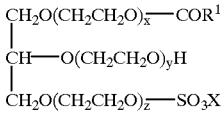

in which $R^1CO$ is a linear or branched acyl group containing 6 to 22 carbon atoms, x, y and z together stand for 0 or a number from 1 to 30 and X is an alkali metal or alkaline earth metal cation, (b) anionic surfactants other than component (a), and (c) amphoteric or zwitterionic surfactants and optionally (d) nonionic surfactants.

14 Claims, No Drawings

AQUEOUS MANUAL DISHWASHING COMPOSITION CONTAINING A MONOGLYCERIDE SULFATE AND AT LEAST TWO OTHER SURFACTANTS

BACKGROUND OF THE INVENTION

This invention relates to water-based manual dishwashing detergents containing monoglyceride (ether)sulfates and other surfactants and to the use of these mixtures for the production of manual dishwashing detergents.

DISCUSSION OF RELATED ART

Concentrated surfactant solutions are normally used for manual dishwashing. Nowadays, the detergents used have to satisfy a whole number of—in some cases very different—requirements. The detergents are expected

- to have a high active substance content,
- to be liquid or at least flowable,
- to have a low cold cloud point,
- to be dermatologically safe, i.e. not to irritate the skin, even in concentrated form,
- to generate a rich, stable foam, even in the presence of fats, and of course
- to have a high cleaning performance.

Even though the consumer can now choose from a whole range of products, there is still considerable interest both on the part of raw material suppliers and detergent manufacturers and on the part of consumers in formulations which fulfill the complex requirement profile involved better than existing products. Accordingly, the problem addressed by the present invention was to satisfy this requirement.

DESCRIPTION OF THE INVENTION

The present invention relates to water-based manual dishwashing detergents containing (a) monoglyceride (ether)sulfates, (b) anionic surfactants and/or (c) nonionic and/or amphoteric or zwitterionic surfactants.

It has surprisingly been found that the detergents according to the invention are flowable, even in highly concentrated form, have a low cold cloud point, do not irritate the skin largely irrespective of their concentration and, at the same time, generate a rich and stable foam, even in the presence of fats, and have an excellent dishwashing performance. The invention includes the observation that mixtures of cocofatty acid monoglyceride sulfate salts with alkyl sulfates, alkyl ether sulfates, sulfosuccinates, alkyl oligoglucosides and/or betaines lead to a further improvement in the desired properties.

Monoglyceride (ether)sulfates

Monoglyceride sulfates and monoglyceride ether sulfates are known anionic surfactants which may be obtained by the relevant methods of preparative organic chemistry. They are normally produced from triglycerides by transesterification to the monoglycerides, optionally after ethoxylation, followed by sulfation and neutralization. The partial glycerides may also be reacted with suitable sulfating agents, preferably gaseous sulfur trioxide or chlorosulfonic acid [cf. EP-B1 0 561 825, EP-B1 0 561 999 (Henkel)]. If desired, the neutralized products may be subjected to ultrafiltration to reduce the electrolyte content to a desired level [DE-A1 42 04 700 (Henkel)]. Overviews of the chemistry of monoglyceride sulfates have been published, for example, by A. K. Biswas et al. in J. Am. Oil. Chem. Soc. 37, 171 (1960) and by F. U. Ahmed in J. Am. Oil. Chem. Soc. 67, 8 (1990). Machine dishwashing detergents containing short-chain alkyl ether sulfates and, optionally, monoglyceride sulfates are the subject of DE-AS 26 13 283 (Procter & Gamble).

The monoglyceride (ether)sulfates suitable for the purposes of the invention correspond to formula (I):

$$\begin{array}{l} CH_2O(CH_2CH_2O)_x\text{—}COR^1 \\ | \\ CH\text{—}O(CH_2CH_2O)_yH \\ | \\ CH_2O(CH_2CH_2O)_z\text{—}SO_3X \end{array} \qquad (I)$$

in which $R^1CO$ is a linear or branched acyl group containing 6 to 22 carbon atoms, x, y and z together stand for 0 or numbers of 1 to 30 and preferably 2 to 10 and X is an alkali metal or alkaline earth metal cation. Typical examples of monoglyceride (ether)sulfates suitable for the purposes of the invention are the reaction products of lauric acid monoglyceride, cocofatty acid monoglyceride, palmitic acid monoglyceride, stearic acid monoglyceride, oleic acid monoglyceride and tallow fatty acid monoglyceride and ethylene oxide adducts thereof with sulfur trioxide or chlorosulfonic acid in the form of their sodium salts. Monoglyceride sulfates corresponding to formula (I), in which $R^1CO$ is a linear acyl group containing 8 to 18 carbon atoms, are preferably used.

Anionic surfactants

Other anionic surfactants different from the monoglyceride (ether)-sulfates are optional ingredients of the manual dishwashing detergents according to the invention. Typical examples of anionic surfactants suitable for use as component (b) are soaps, alkyl benzenesulfonates, alkane sulfonates, olefin sulfonates, alkyl ether sulfonates, glycerol ether sulfonates, α-methyl ester sulfonates, sulfofatty acids, alkyl sulfates, alkyl ether sulfates, glycerol ether sulfates, hydroxy mixed ether sulfates, fatty acid amide (ether)-sulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurides, N-acylamino acids such as, for example, acyl lactylates, acyl tartrates, acyl glutamates and acyl aspartates, alkyl oligoglucoside sulfates, protein fatty acid condensates (particularly wheat-based vegetable products) and alkyl (ether)phosphates. If the anionic surfactants contain polyglycol ether chains, the polyglycol ether chains may have a conventional homolog distribution, although they preferably have a narrow homolog distribution. Alkyl sulfates, alkyl ether sulfates and/or sulfosuccinates are preferably used. The detergents according to the invention may contain components (a) and (b) in a ratio by weight of 90:10 to 10:90, preferably 75:25 to 15:85 and more preferably 60:40 to 25:75.

Nonionic and amphoteric surfactants

Typical examples of nonionic surfactants suitable for use as component (c) are fatty alcohol polyglycol ethers, alkyl phenol polyglycol ethers, fatty acid polyglycol esters, fatty acid amide polyglycol ethers, fatty amine polyglycol ethers, alkoxylated triglycerides, alk(en)yl oligoglycosides, fatty acid-N-alkyl glucamides, protein hydrolyzates (particularly wheat-based vegetable products), polyol fatty acid esters, sugar esters, sorbitan esters, polysorbates and amine oxides. If the nonionic surfactants contain polyglycol ether chains, the polyglycol ether chains may have a conventional homolog distribution although they preferably have a narrow homolog distribution. Typical examples of amphoteric or zwitterionic surfactants are alkyl betaines, alkyl amidobetaines, aminopropionates, aminoglycinates, imidazolinium betaines and sulfobetaines. Fatty alcohol polyglycol ethers, alkyl oligoglucosides, fatty acid-N-alkyl glucamides and/or betaines are preferably used. The detergents according to the invention may contain components (a) and (c) in a ratio by weight of 90:10 to 10:90, preferably 75:25 to 25:75 and more preferably 60:40 to 40:60 and components (a), (b) and (c) in a ratio by weight of (10 to 90): (5 to 85): (5 to 85) and, more particularly, (20 to 80): (10 to 50): (10 to 50), with the proviso that the quantities by weight shown add up to 100% by weight, based on components (a), (b) and/or (c).

Commercial Applications

The present invention relates to the use of the surfactant mixtures according to the invention for the production of manual dishwashing detergents. In this connection, the mixtures may contain small quantities of other typical auxiliaries and additives such as, for example, foam boosters, fragrances, etc. The detergents normally have an active substance or surfactant content, based on components (a), (b) and/or (c), of 10 to 50% by weight and preferably 15 to 35% by weight.

EXAMPLES

Foaming behavior was determined by the Ross-Miles Method using 1% by weight surfactant solutions at 20° C. in the presence of 1 g/l of dispersed olive oil. The results of this test are expressed as the basic foam and the foam height after 5 minutes. Dishwashing performance was determined by the plate test [Fette, Seifen, Anstrichmitt., 74, 163 (1972)]. To this end, 14 cm diameter plates were each soiled with 2 $cm^3$ of beef tallow (acid value 9–10) and stored for 24 h at room temperature. The plates were then rinsed with 5 liters of tap water (hardness 16° d) at 50° C. The test mixtures were used with a dosage of 0.15 g of active substance/l. The dishwashing test was terminated when the foam had completely disappeared. To determine skin-cosmetic compatibility, the dermatological compatibility of comparison formulation F9 as determined by the Zein test was selected as the standard on which all the results were based. Formulations F1 to F8 correspond to the invention while formulations F9 and F10 are intended for comparison. The results are set out in Table 1.

TABLE 1

Properties of surfactant mixtures (quantities in % by weight)

| | F1 | F2 | F3 | F4 | F5 | F6 | F7 | F8 | F9 | F10 |
|---|---|---|---|---|---|---|---|---|---|---|
| Cocofatty acid monoglyceride sulfate sodium salt | 15 | 15 | 15 | 15 | — | 12 | 12 | 12 | — | — |
| Cocofatty acid alcohol + 2EO sulfate sodium salt | 15 | — | — | — | — | 12 | 12 | 12 | 30 | 15 |
| Lauryl sulfate sodium salt | — | 15 | — | — | — | — | — | — | — | — |
| Di-n-octyl + 2EO sulfosuccinate sodium salt | — | — | 15 | — | — | — | — | — | — | — |
| Cocoalkyl oligoglucoside | — | — | — | 15 | — | 6 | — | 3 | — | 15 |
| Cocofatty acid betaine | — | — | — | — | 15 | — | 6 | 3 | — | — |
| Water | to 100 | | | | | | | | | |
| Basic foam [ml] | 420 | 400 | 410 | 410 | 390 | 410 | 410 | 410 | 400 | 380 |
| Foam height after 5 mins. [ml] | 380 | 380 | 380 | 380 | 380 | 380 | 390 | 390 | 370 | 350 |
| Number of clean plates | 14 | 14 | 15 | 14 | 14 | 15 | 17 | 20 | 12 | 12 |
| Cold cloud point [° C.] | <-3 | <-3 | <-3 | <-3 | <-3 | <-3 | <-3 | <-3 | 0 | 0 |
| Dermatological compatibility [%-rel] | 63 | 69 | 61 | 59 | 59 | 57 | 57 | 55 | 100 | 70 |

What is claimed is:

1. A water-based manual dishwashing detergent composition comprising (a) monoglyceride sulfates or monoglyceride ether sulfates corresponding to formula (I):

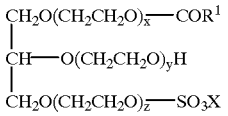

(I)

in which $R^1CO$ is a linear or branched acyl group containing 6 to 22 carbon atoms, x, y and z together stand for 0 or a number from 1 to 30 and X is an alkali metal or alkaline earth metal cation, (b) anionic surfactants other than component (a), and (c) amphoteric or zwitterionic surfactants.

2. A manual dishwashing detergent composition as in claim 1 wherein said anionic surfactants are selected from the group consisting of alkyl sulfates, alkyl ether sulfates, and sulfosuccinates.

3. A manual dishwashing detergent composition as in claim 1 wherein said amphoteric or zwitterionic surfactants comprise betaines.

4. A manual dishwashing detergent composition as in claim 1 wherein said nonionic surfactants are selected from the group consisting of fatty alcohol polyglycol ethers, alkyl oligoglucosides, and fatty acid-N-alkyl glucamides.

5. A manual dishwashing detergent composition as in claim 1 wherein said components (a), (b) and (c) are present in a ratio by weight of (10 to 90): (5 to 85): (5 to 85), with the proviso that the quantities by weight shown add up to 100% by weight.

6. A manual dishwashing detergent composition as in claim 1 having a surfactant content, based on components (a), (b), (c) and optionally (d), of 10 to 50% by weight, based on the weight of said composition.

7. A manual dishwashing detergent composition as in claim 1 wherein in said monoglyceride sulfates $R^1CO$ is a linear acyl group containing 8 to 18 carbon atoms.

8. The process of manually washing dishware comprising contacting said dishware with a detergent composition comprising (a) monoglyceride sulfates or monoglyceride ether sulfates corresponding to formula (I):

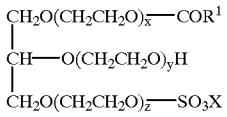

(I)

in which $R^1CO$ is a linear or branched acyl group containing 6 to 22 carbon atoms, x, y and z together stand for 0 or a number from 1 to 30 and X is an alkali metal or alkaline earth metal cation, (b) anionic surfactants other than component (a), and (c) amphoteric or zwitterionic surfactants and optionally (d) nonionic surfactants.

9. A process as in claim 7 wherein said anionic surfactants are selected from the group consisting of alkyl sulfates, alkyl ether sulfates, and sulfosuccinates.

10. A process as in claim 7 wherein said amphoteric or zwitterionic surfactants comprise betaines.

11. A process as in claim 7 wherein said nonionic surfactants are selected from the group consisting of fatty alcohol polyglycol ethers, alkyl oligoglucosides, and fatty acid-N-alkyl glucamides.

12. A process as in claim 7 wherein said components (a), (b) and (c) are present in a ratio by weight of (10 to 90): (5 to 85): (5 to 85), with the proviso that the quantities by weight shown add up to 100% by weight.

13. A process as in claim 7 wherein said composition has a surfactant content, based on components (a), (b), (c) and optionally (d), of 10 to 50% by weight, based on the weight of said composition.

14. A manual dishwashing detergent composition as in claim 7 wherein in said monoglyceride sulfates $R^1CO$ is a linear acyl group containing 8 to 18 carbon atoms.

* * * * *